US006834659B2

(12) United States Patent
Liu et al.

(10) Patent No.: US 6,834,659 B2
(45) Date of Patent: Dec. 28, 2004

(54) RIB ASSEMBLY FOR MULTI-FOLDABLE UMBRELLA

(75) Inventors: Fu-Tien Liu, P.O. Box No. 6-57, Chung-Ho, Taipei 235 (TW); Ping-Tung Su, P.O. Box No. 6-57, Chung-Ho, Taipei 235 (TW)

(73) Assignees: Fu-Tien Liu, Lu-Chou (TW); Ping-Tung Su, Hsin-Chu (TW)

( * ) Notice: Subject to any disclaimer, the term of this patent is extended or adjusted under 35 U.S.C. 154(b) by 0 days.

(21) Appl. No.: 10/330,235

(22) Filed: Dec. 30, 2002

(65) Prior Publication Data

US 2004/0123888 A1 Jul. 1, 2004

(51) Int. Cl.[7] ..... A46B 19/10

(52) U.S. Cl. ..... 135/23.5; 135/25.31; 135/29

(58) Field of Search ..... 248/25.3, 25.31, 248/29, 30, 31, 25.32, 23

(56) References Cited

U.S. PATENT DOCUMENTS

| | | | | | |
|---|---|---|---|---|---|
| 4,766,917 | A | * | 8/1988 | Yang | 135/25.3 |
| 5,193,565 | A | * | 3/1993 | Huang | 135/25.2 |
| 5,551,463 | A | * | 9/1996 | Wang | 135/25.3 |
| 6,164,302 | A | * | 12/2000 | Ko | 135/25.3 |
| 6,164,303 | A | * | 12/2000 | Lin et al. | 135/29 |
| 6,244,284 | B1 | * | 6/2001 | Wang | 135/31 |
| 6,394,115 | B1 | * | 5/2002 | Tsun | 135/25.3 |
| 6,470,899 | B2 | * | 10/2002 | Johnson et al. | 135/29 |
| 6,497,242 | B1 | * | 12/2002 | Lin et al. | 135/31 |

* cited by examiner

*Primary Examiner*—Anita King
*Assistant Examiner*—Amy J. Sterling

(57) ABSTRACT

The rib assembly for multi-foldable umbrella includes an inner rib, a middle rib, an outer rib and a secondary rib. Wherein, the secondary rib and the front strut are solid shafts and the pivot joint of the secondary rib and the inner rib is not necessitated to be flat in shape. Therefore the supporting strength of the secondary rib and the front strut against bending are increased, and the volume thereof is also effectively reduced for further significantly decreasing the volume of the collapsed umbrella as a whole, thereby bringing better convenience for carrying.

5 Claims, 7 Drawing Sheets

RIB ASSEMBLY FOR MULTI-FOLDABLE UMBRELLA

BACKGROUND OF THE INVENTION (a) Field of the Invention

The invention relates to a technique for umbrella, and more particularly, to a rib assembly for multi-foldable umbrella.

(b) Description of the Related Art

Umbrellas are easy and practical to use for sheltering from the rain, and therefore they have long been important commodities in every day life of humans. Multi-foldable umbrellas especially, which can be folded for even more convenient storage and carrying, have gained favors of and are being used by the majority among the users. However, multi-foldable umbrellas are convenient for storage because the volume of the umbrella bodies thereof can be decreased, and rib assemblies of prior umbrellas are U-shaped with hollow interiors, meaning that such rib assemblies are larger in volume, and the spaces dented within the U-shaped ribs are comparatively deeper, leaving the rib assemblies with insufficient hardness against bending and twisting caused by windy weathers or accidental impacts. Soon after that, solid rib assemblies had become available; they are significantly smaller in volume compared to that of the previous umbrellas and bring even better convenience for storage and carrying. Nevertheless, for common solid rib assemblies, the pivotal joints having pivot points for fixing the main post and the rib assemblies are flat in shape, thereby greatly reducing the hardness of the pivotal joints of the rib assemblies as well.

SUMMARY OF THE INVENTION

The object of the invention is to provide a rib assembly for umbrella that provides a greater strength and effectively reduces the volume of umbrellas, thereby bringing better convenience for carrying.

The rib assembly for multi-foldable umbrella comprises a secondary rib and a front strut that are solid shafts, and the pivot joint of the middle segment of the secondary rib and an inner rib is a bent section covered with a middle junction.

The bent section of the secondary rib is bent toward the inner rib pivotally connected, and the axle pin pivotally disposed is lodged and fastened to the pivot point of the middle junction.

The bent section of the secondary rib may also be bent toward the other side of the inner rib pivotally connected. The middle junction is provided with an opening for coordinating with the bent section of the secondary rib, and an axle pin pivotally disposed is lodged and fastened to the pivot point of the middle junction.

The middle junction may also directly cover and clamp the middle segment of the shaft-like secondary rib, and an axle pin pivotally disposed is lodged and fastened to the pivot point of the middle junction.

One side of the front strut is provided with a groove having an arched bottom, that is, the cross section of the front strut is a crescent in shape.

DETAILED DESCRIPTION OF THE PREFERRED EMBODIMENTS

Figure 1:
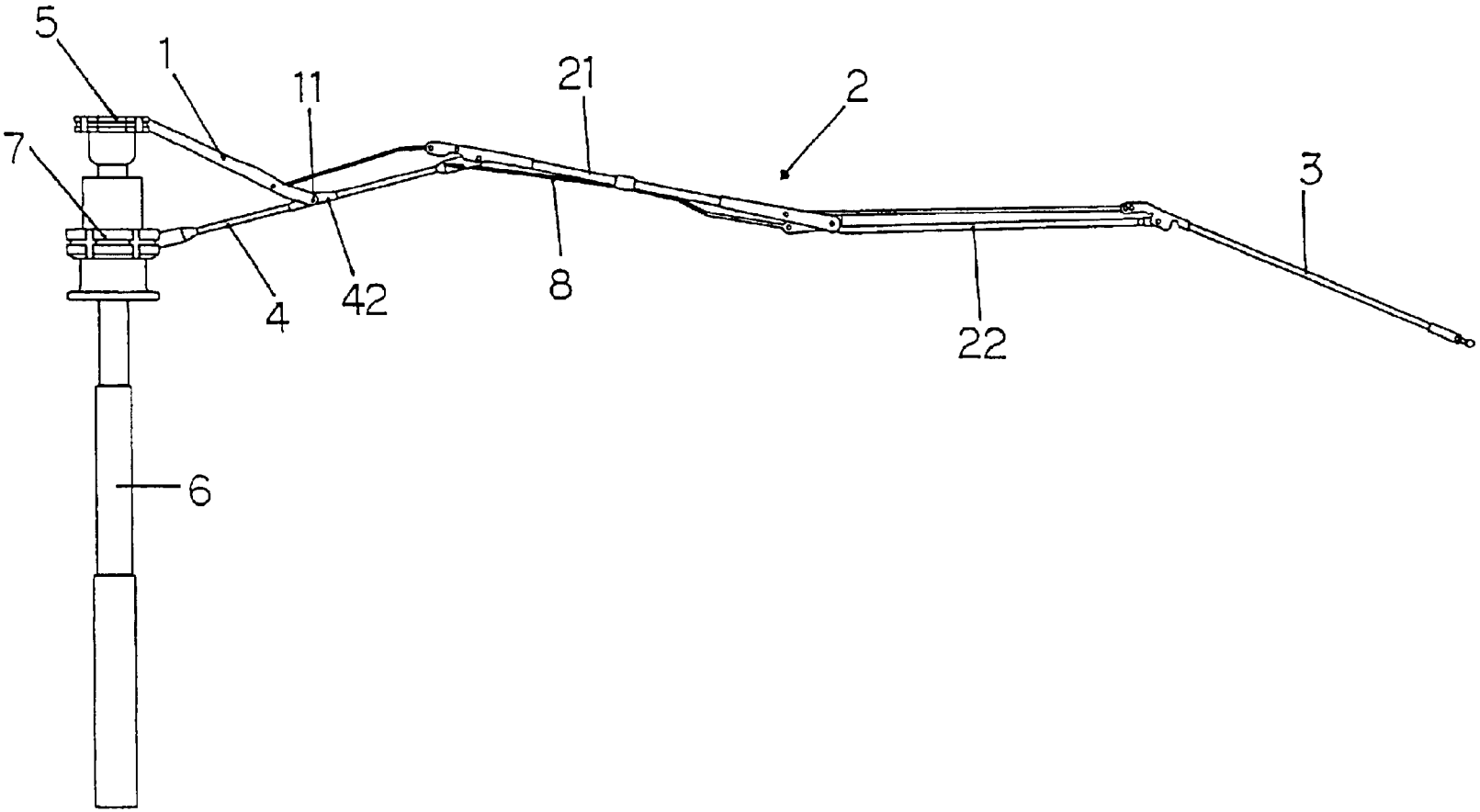
FIG. 1 shows a schematic view of the structure in accordance with the invention.
Figure 2:
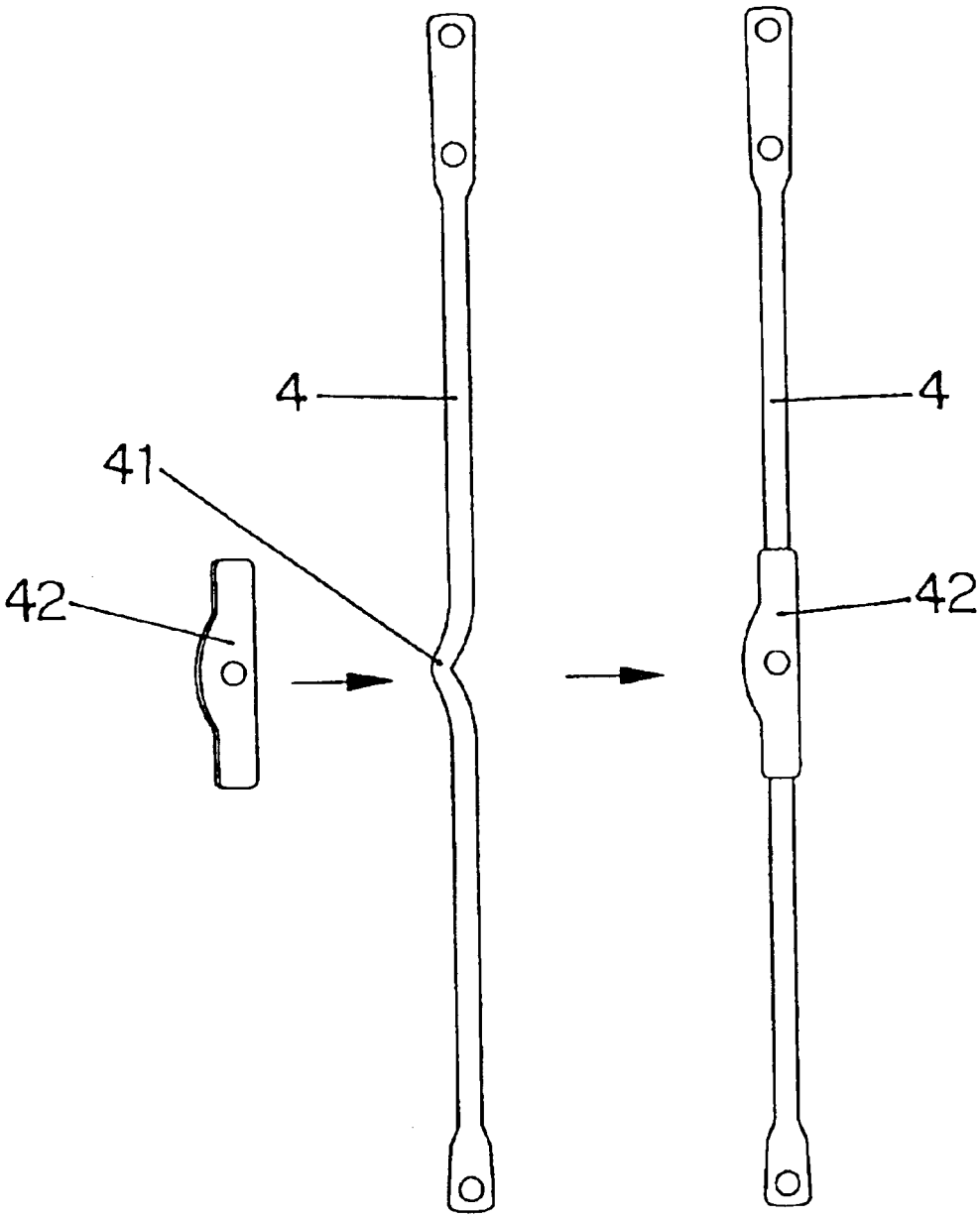
FIG. 2 shows a schematic view of the secondary rib structure in accordance with the invention.
Figure 3:
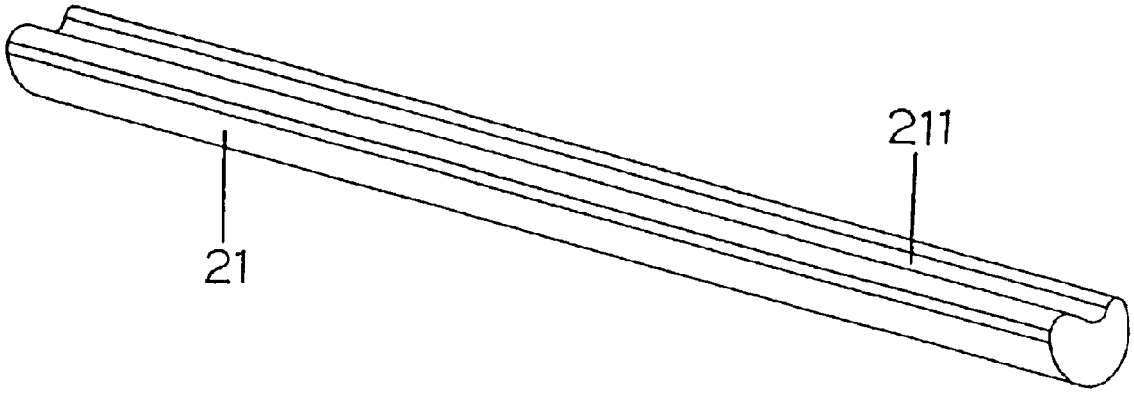
FIG. 3 shows an elevational view of the front strut in accordance with the invention.
Figure 4:
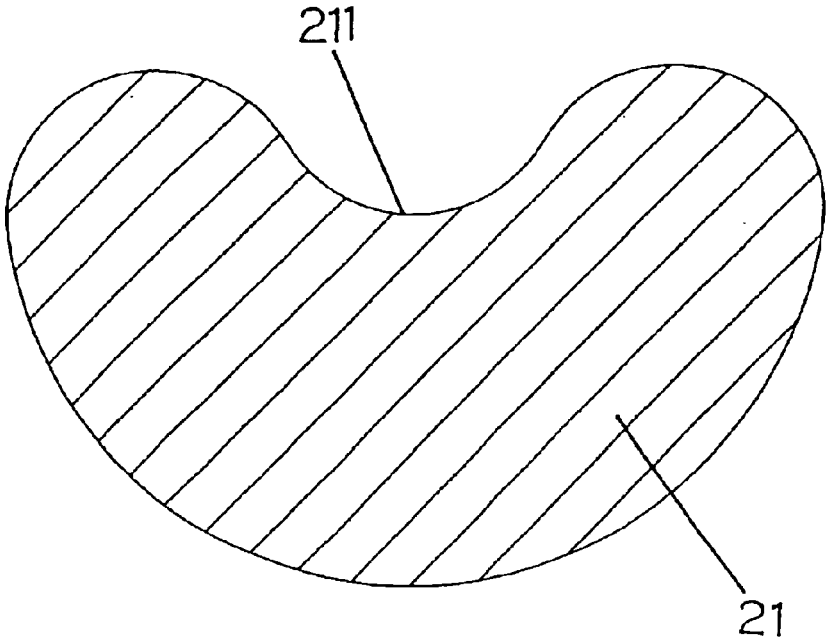
FIG. 4 shows a sectional schematic view of the front strut in accordance with the invention.
Figure 5:
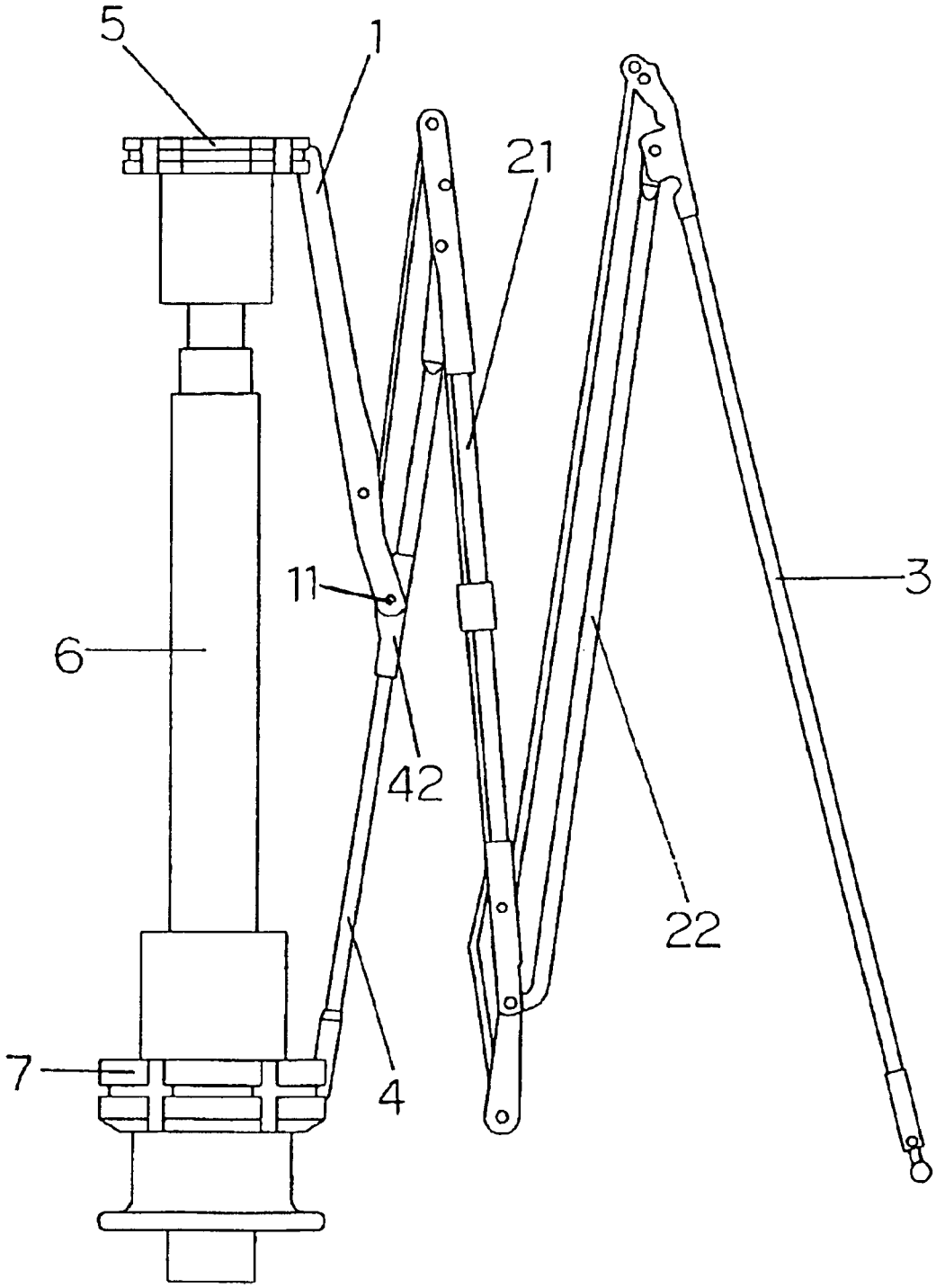
FIG. 5 shows a schematic view of a half-collapsed umbrella in accordance with the invention.
Figure 6:
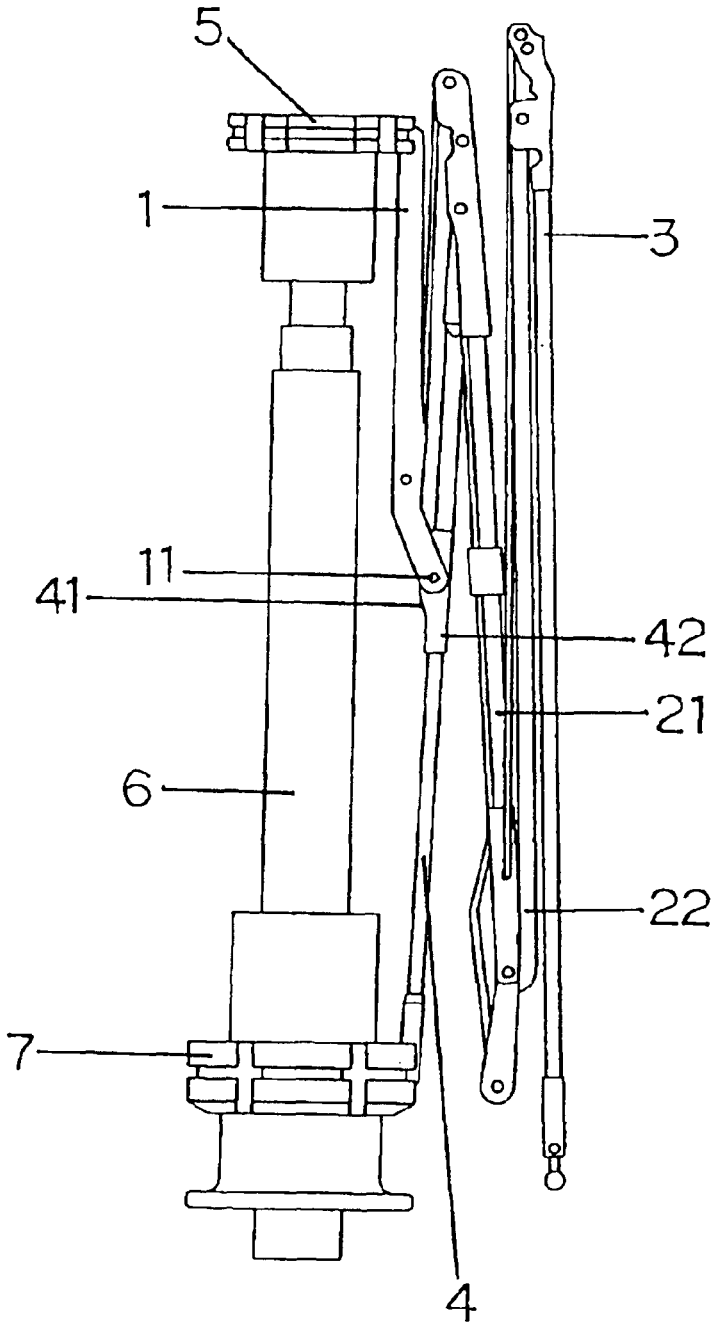
FIG. 6 shows a schematic view of a fully collapsed umbrella in accordance with the invention.

Referring to FIGS. 1 to 6, the rib assembly according to the invention comprises an inner rib 1, a middle rib 2, and an outer rib 3 and a secondary rib 4, wherein the middle rib 2 is formed by pivotally connecting a front strut 21 and a back strut 22. One end of the inner rib 1 is pivotally connected to the upper nest 5, and the other end thereof is pivotally connected to the middle segment of the secondary rib 4. The upper nest 5 is fastened at one end of a post 6, and the other end thereof is penetrated through an inner opening of a lower nest 7 in a flexible manner such that between the post 6 and the lower nest 7 is a mobile connection. One end of the secondary rib 4 is pivotally connected to the lower nest 7, and the other end thereof is pivotally connected to the front strut 21. The outer end of the back strut 22 is pivotally connected to the outer rib 3. The secondary rib 4 and the front strut 21 are solid shafts, and pivot joint of the middle segment of the secondary rib 4 and the inner rib 1 is a bent section covered with a middle junction 42. The bent section 41 of the secondary rib 4 is bent toward the inner rib 1 pivotally connected, and an axle pin 11 is lodged and fastened to the inner side of the bent section 41. The front strut 21 is a formed integral of a solid shaft made from carbon fiber or glass fiber. One side of the front strut 21 is provided with a groove 211 having an arched bottom, that is, the cross section thereof is a crescent in shape, and the groove 211 is and for accommodating a corresponding connecting rib 8.

By moving the lower nest 7 upwards, the secondary 4 is impelled and stretched, and the inner rib 1, the front and back struts 21 and 22, and the outer rib 3 are also subsequently stretched. Wherein, the pivot joint of the middle segment of the secondary rib 4 and the inner rib 1 is a bent section 41, and the axle pin 11 pivotally disposed is lodged and fastened to the inner side of the bent section 41, so that the pivot joint of the secondary rib 4 and the inner rib 1 is not necessitated to be a flat object, while providing sufficient hardness against breakage. Also, being a solid shaft made from carbon fiber or glass fiber, the front strut 21 has a greater hardness and is not easily twisted or deformed as well as offering a larger strength for stretching the canopy even tighter, thereby facilitating the usage of the umbrella. When moving the lower nest 7 download to collapse the umbrella, the secondary rib 4 is impelled by the lower nest 7 to further collapse downwardly toward the post 6. In the meantime, the inner rib 1 and the front strut 21 are also acted upon by the secondary rib 4 to collapse toward the post 6, and the back strut 22 and the outer rib 3 subsequently collapse similarly. Because the secondary rib 4 and the front strut 21 are solid shafts, the volume thereof is smaller compared to that of a U-shaped rib assembly. The secondary rib 4, the middle rib 2 and the outer rib 3 are then able to collapse inwardly with a larger degree, and the collapsed volume thereof as a whole is significantly reduced, thereby providing the user with better convenience when carrying.

Figure 7:
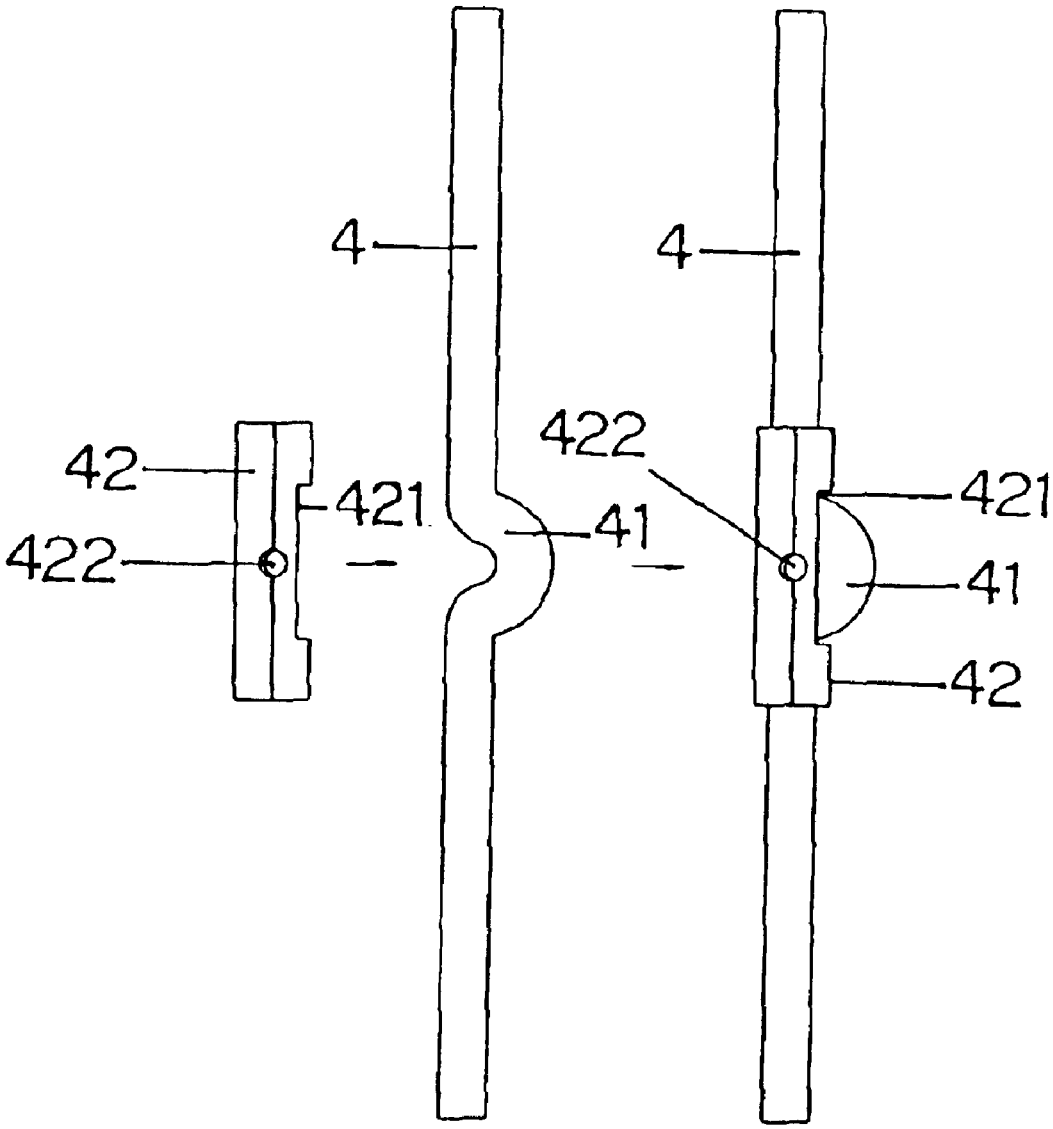
FIG. 7 is a schematic showing the connection between the secondary rib and the middle junction in another embodiment in accordance with the invention.

Referring to FIG. 7 is a schematic view showing a connection between the secondary rib 4 and the middle junction 42 of another embodiment, wherein the bent section 41 of the secondary rib 4 is bent toward the other side of the inner rib 1 pivotally connected. The middle junction 42 is provided with an opening 421 for coordinating with the bent section 41 of the secondary rib 4, and the axle pin 11 pivotally disposed is lodged and fastened into the pivot point 422 of the middle junction 42.

Figure 8:
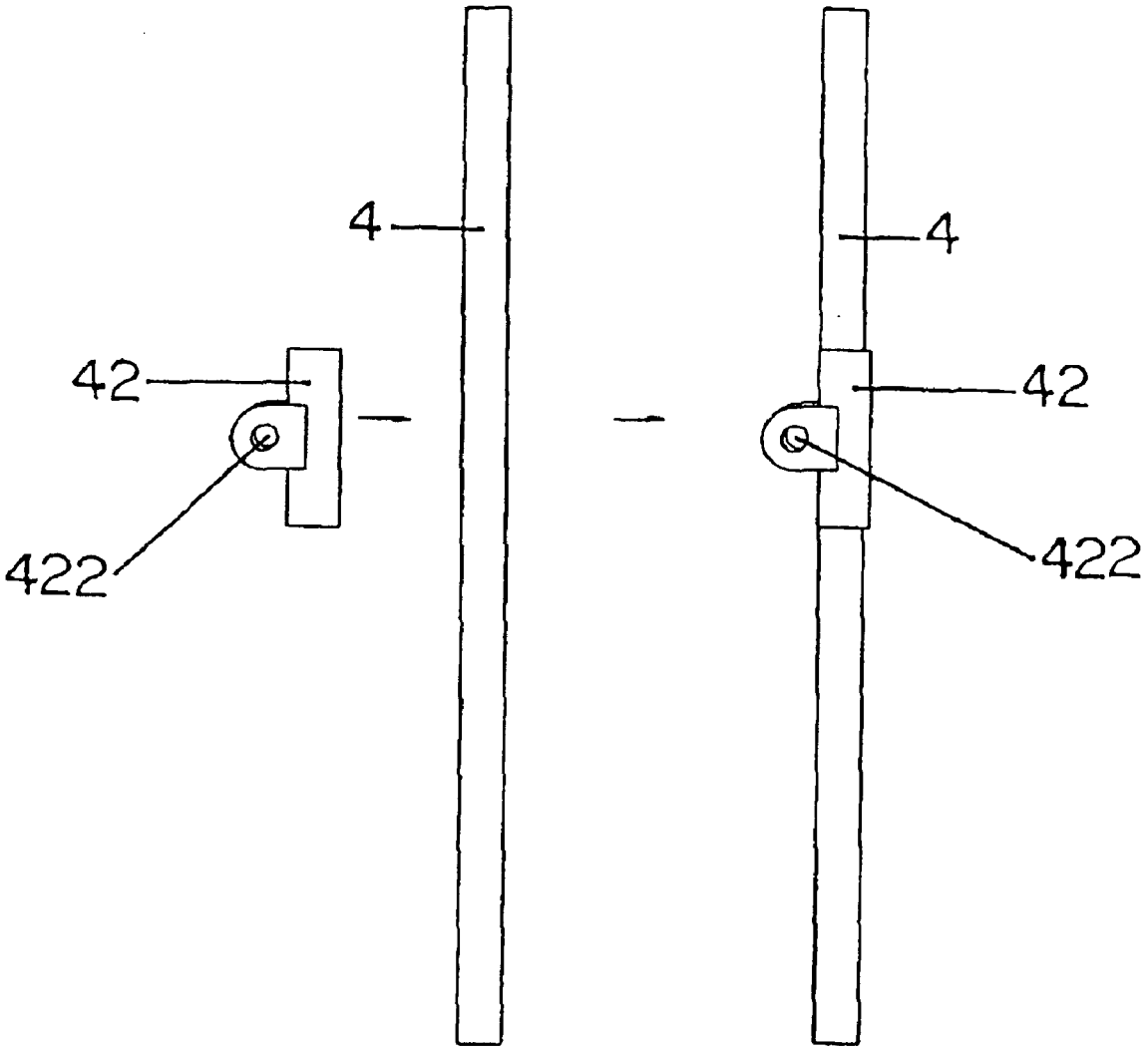
FIG. 8 is a schematic showing the connection between the secondary rib and the middle junction in another embodiment in accordance with the invention.

Referring to FIG. 8 showing a schematic view of a connection between the secondary rib 4 and the middle junction 42 according to another embodiment, wherein the middle junction 42 directly covers and clamps the middle segment of the shaft-like secondary rib 4, and the axle pin 11 pivotally disposed is connected to the pivot point 422 of the middle junction 42.

The shape and structure of the front strut 21 is also suitable for other rib assemblies, which may further form umbrellas that are small in size having practicability.

It is observed from the structure described above that the rib assembly in accordance with the invention effectively reduces the volume of umbrellas and provides better convenience for carrying, as well as increasing the supporting strength of the secondary rib and the front strut, thereby providing not only practical but also commercial values.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A rib assembly for multi-foldable umbrella comprising an inner rib, a middle rib, an outer rib and a secondary rib; wherein the middle rib is formed by pivotally connecting a front strut and a back strut, one end of the inner rib is pivotally connected to an upper nest and the other end thereof is pivotally connected to the middle segment of the secondary rib, one end of the secondary rib is pivotally connected to the lower nest since the other end thereof is pivotally connected to front strut, and the other end of the back strut is pivotally connected to the outer rib; and the characteristics thereof are that the secondary rib and the front strut are solid shafts, and the pivot joint of the middle segment of the secondary rib and the inner rib is provided with a bent section covered with a middle junction.

2. The rib assembly for multi-foldable umbrella in accordance with claim 1, wherein the bent section of the secondary rib is bent toward the inner rib and is pivotally connected thereto, and an axle pin pivotally disposed is lodged and fastened to the pivot point of the middle junction for coordinating with the inner side of the bent section.

3. The rib assembly for multi-foldable umbrella in accordance with claim 1, wherein the bent section of the secondary rib is bent toward the inner rib and is pivotally connected thereto, the middle junction is provided with an opening for coordinating with the bent section of the secondary rib, and an axle pin pivotally disposed is lodged and fastened to the pivot point of the middle junction.

4. The rib assembly for multi-foldable umbrella in accordance with claim 1, wherein the middle junction directly covers and clamps the middle segment of the shaft-like secondary rib, and an axle pin pivotally disposed is lodged and fastened to the pivot point of the middle junction.

5. The rib assembly for multi-foldable umbrella in accordance with claim 1, wherein one side of the front strut is provided with a groove having an arched bottom, that is, the cross section of the front strut is a crescent in shape.

* * * * *